US010012465B1

(12) United States Patent
Liechty

(10) Patent No.: US 10,012,465 B1
(45) Date of Patent: Jul. 3, 2018

(54) MODULAR DEVICE SUPPORT SYSTEM

(71) Applicant: George Liechty, Mapleton, UT (US)

(72) Inventor: George Liechty, Mapleton, UT (US)

( * ) Notice: Subject to any disclaimer, the term of this patent is extended or adjusted under 35 U.S.C. 154(b) by 0 days.

(21) Appl. No.: 15/067,100

(22) Filed: Mar. 10, 2016

Related U.S. Application Data

(60) Provisional application No. 62/131,251, filed on Mar. 11, 2015.

(51) Int. Cl.
*F41A 23/10* (2006.01)

(52) U.S. Cl.
CPC ..... *F41A 23/10* (2013.01)

(58) Field of Classification Search
CPC ..... F41A 23/08; F41A 23/10
See application file for complete search history.

(56) References Cited

U.S. PATENT DOCUMENTS

| | | | | |
|---|---|---|---|---|
| 7,676,977 | B1 * | 3/2010 | Cahill | F16M 11/16 248/168 |
| 8,402,684 | B1 | 3/2013 | Beltz | |
| 2013/0174463 | A1 * | 7/2013 | Hinds | F41A 23/04 42/94 |
| 2014/0115940 | A1 * | 5/2014 | Bonelli | F16M 11/14 42/94 |
| 2016/0209172 | A1 * | 7/2016 | Trotabas | F41G 1/44 |

* cited by examiner

*Primary Examiner* — Stephen Johnson

(57) ABSTRACT

A modular device support system including a top body for attaching to any device needing support and a main body capable of connecting to the top body. The main body has two attachment pivots connected to opposing side walls, the attachment pivots may be pivotably mounted to the opposing side walls so that each attachment pivot can be adjustably positioned in at least one position of a plurality of positions. At least one accessory can connect to the attachment pivots.

9 Claims, 9 Drawing Sheets

MODULAR DEVICE SUPPORT SYSTEM

CROSS-REFERENCE TO RELATED APPLICATIONS

This application claims the benefit of U.S. Provisional Patent Application No. 62/131,251, filed Mar. 11, 2015 the contents of which are herein incorporated by reference in their entireties.

FIELD OF TECHNOLOGY

This disclosure relates generally to the field of device support systems and more specifically to a modular device support system.

BACKGROUND

A device support system, specifically a bipod, has been a staple accessory for many military firearms and used by other firearm enthusiasts. Generally, a bipod supports the front end of a firearm and has two legs that can be placed on the ground, providing stability and support for a weapon when fired. However, a traditional bipod can be bulky, heavy, and difficult to carry. Furthermore, firearm users often need to shoot their firearms in areas that have varying or uneven terrain such as rocky or sandy conditions and traditional bipods do not function well with the varying or uneven terrain.

Therefore there is a need for a device support system that is modular in design and offers the ability to adjust the leg length and leg position or exchange the legs for another accessory altogether so a firearm user can position their firearm in an optimal firing position, regardless of the terrain or surface.

SUMMARY OF THE INVENTION

It is therefore an object of the invention to provide a device support system that is modular (i.e. capable of being easily separated into different pieces) and has legs that are capable of adjustment in length and position and can be removed or replaced with another leg or accessory.

To this end, the invention proposes a modular device support system that includes a top body for attaching to the device needing support and a main body capable of connecting to the top body, the main body having two attachment portions connected to opposing side walls. Legs or other accessories can be quickly attached or detached from the attachment portions.

In one embodiment, a modular device support system includes a top body for attaching to the device needing system, a main body with two attachment pivots that can rotate and lock in a plurality of positions about the main body, and a pivot system between the top body and the main body permitting movement along a longitudinal axis. The system may also include legs or other accessories can be quickly attached or detached from the attachment portions.

In another embodiment, a modular device support system includes a top body for attaching to a device needing support; a main body having a side wall and an opposing side wall, the side wall and the opposing side wall each having a plurality of recesses, the top body and main body capable of connecting to each other; a first attachment pivot mounted on the side wall of the main body that can rotate independently to any recess of the plurality of recesses and be adjustably fixed in one position of a plurality of positions by a structure on the first attachment pivot mating with one of the recesses of the plurality of recesses; a second attachment pivot mounted on the opposing side wall of the main body that can rotate independently to any recess of the plurality of recesses and be adjustably fixed in one position of a plurality of positions by a structure on the second attachment pivot mating with one of the recesses of the plurality of recesses; and at least one accessory that can connect to the first attachment pivot and the second attachment pivot.

In yet another embodiment the modular device support system includes a clamp for removably attaching to a device needing support; a main body having a side wall and an opposing side wall, the side wall and the opposing side wall each having a plurality of recesses, a first attachment pivot mounted on the side wall of the main body that can rotate independently to any recess of the plurality of recesses and be adjustably fixed in one position of a plurality of positions by a structure on the first attachment pivot mating with one of the recesses of the plurality of recesses, a second attachment pivot mounted on the opposing side wall of the main body that can rotate independently to any recess of the plurality of recesses and be adjustably fixed in one position of a plurality of positions by a structure on the second attachment pivot mating with one of the recesses of the plurality of recesses; a pivot system connecting the clamp and the main body and permitting movement along a longitudinal axis, a first leg that can removably connect to the first attachment pivot; and a second leg that can removably connect to the second attachment pivot.

The modular device support system in any of these embodiments can be designed to support a firearm, camera, binoculars or other device needing support.

BRIEF DESCRIPTION OF THE DRAWINGS

Example embodiments are illustrated by way of example and not limitation in the accompanying figures, in which like references indicate similar elements and in which.

Other features of the present embodiments will be apparent from the accompanying drawings and from the detailed description that follows.

DETAILED DESCRIPTION

Disclosed is an apparatus for a modular device support system. Although the present embodiments have been described with reference to specific example embodiments, it will be evident that various modifications and changes may be made to these embodiments without departing from the broader spirit and scope of the various embodiments.

Figure 1:
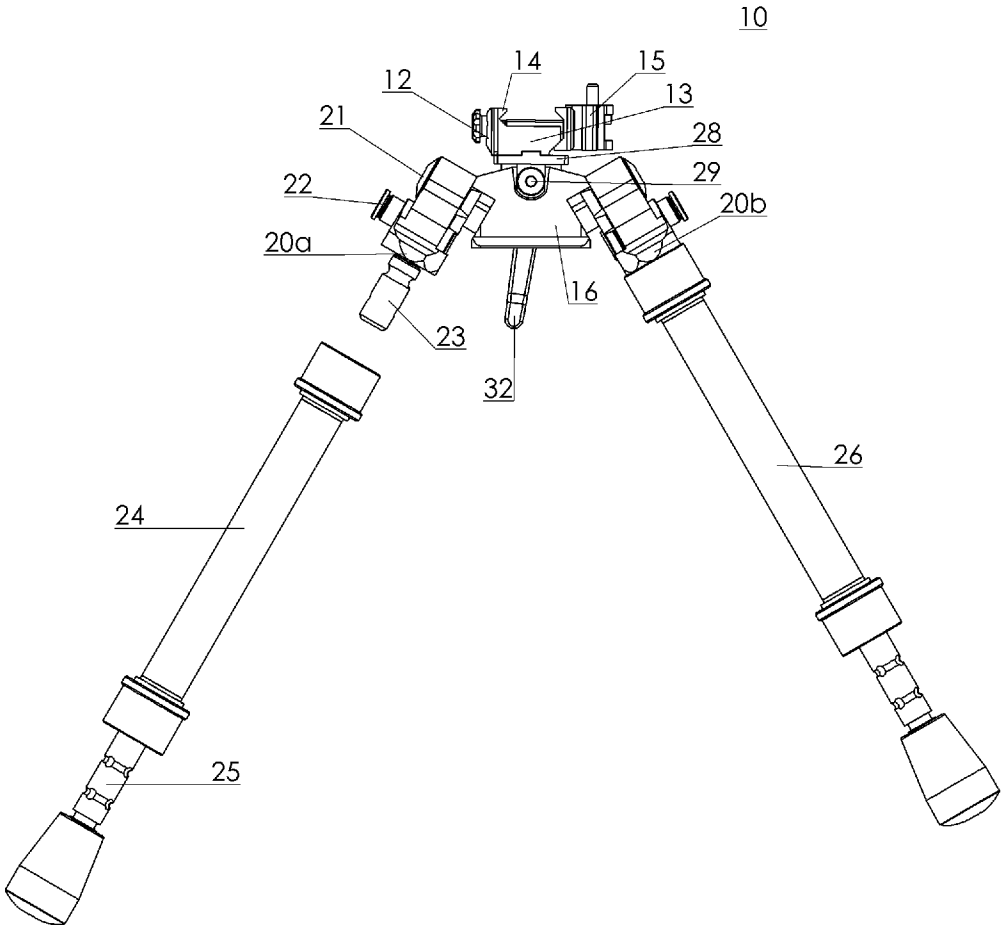
FIG. 1 is a front view of a modular device support system with one leg connected to a main body and one leg disconnected, according to one embodiment.

In one embodiment, as shown in FIG. 1, a modular device support system is shown with one leg connected to a main body and one leg disconnected from the main body. The modular device support system may be designed to support a firearm, camera, video camera, spotting scope, binoculars or other device that needs to be stabilized. A firearm may include any firearm with a long barrel, including but not limited to a rifle, pistol, shotgun, pellet gun, paint gun, etc. The modular support system in this embodiment is a bipod, the bipod 10 includes a clamp 12, a main body 16 with attachment pivots 20*a* and 20*b*, and two legs 24, 26. For illustrative purposes only, the bipod is described has being used with a firearm. It should be understood that the clamp on the bipod could be configured to allow the bipod to support devices other than a firearm.

Figure 2:
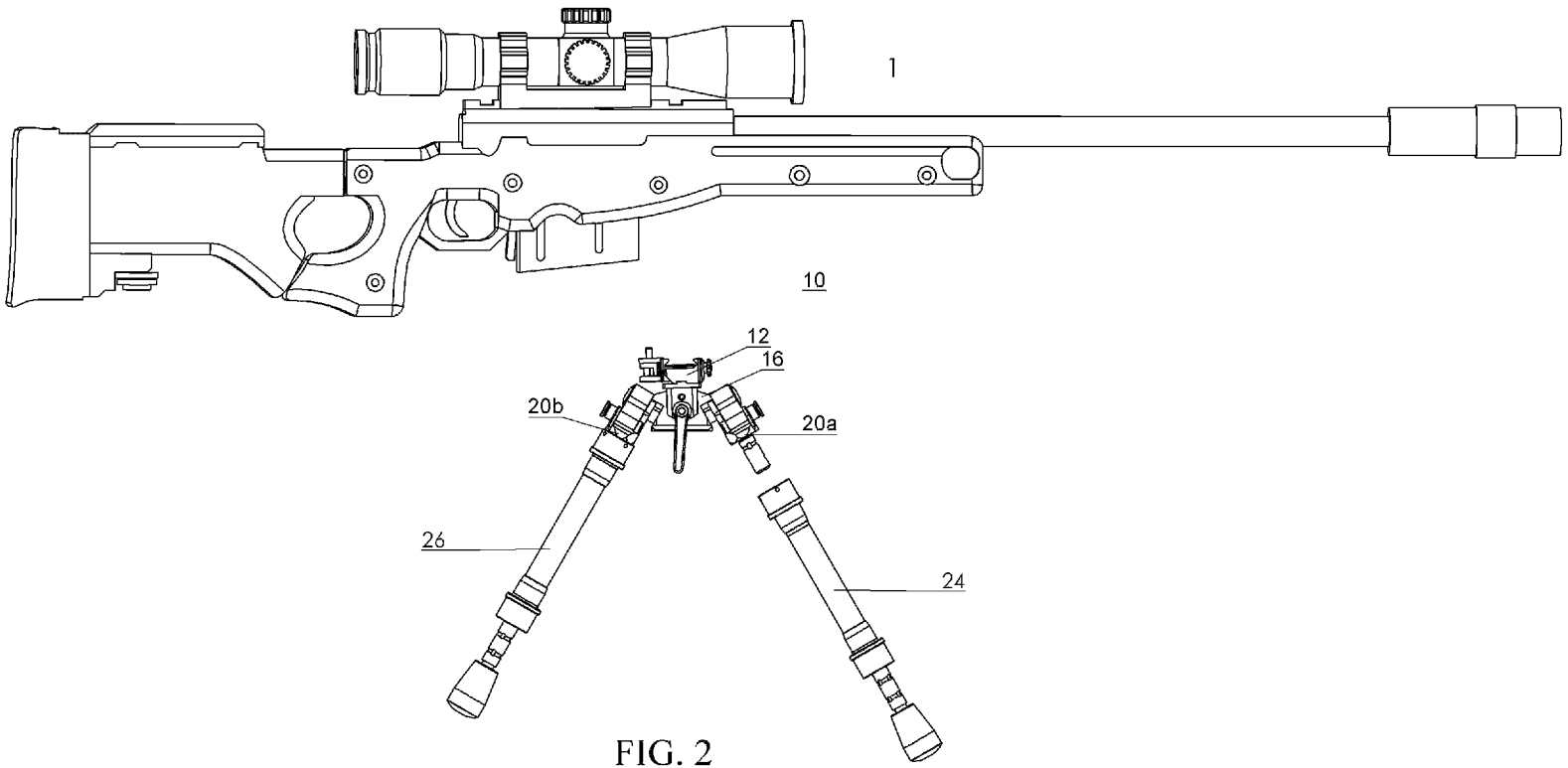
FIG. 2 is a back view of a modular device support system with one leg connected to a main body and one leg disconnected, according to one embodiment.

The clamp 12 is used for securely attaching the bipod 10 to a firearm 1, as shown in FIG. 2. The clamp 12 will attach to a firearm with an accessory rail located on the barrel of the firearm. Accessory rails are well known in the art and often come pre-installed on firearms or can easily be installed on a firearm. The clamp 12 can be sized to work with any accessory rail that is available. Furthermore, a top body could be used instead of a clamp, the top body could be any fixture that is capable of attaching to the device needing support and to the main body. The clamp 12 may include a clamp body 13, clamp claws 14, and a tightening lever 15, but it should be understood that any mounting mechanism known in the art could be used. The clamp 12 or top body could have any mounting mechanism that allows a firearm or device to be securely engaged to the bipod.

The main body 16 has two attachment pivots 20*a*, 20*b*. The attachment pivots 20*a*, 20*b* can be attached to the main body by any means known in the art such as a bolt, screw axle, spindle, pin, bearings, etc. In FIG. 1, the attachment pivots 20*a*, 20*b* are attached to the main body with a bolt 21. The attachment pivots 20*a*, 20*b* pivot around the bolt 21 into one of a plurality of positions. The attachment pivots 20*a*, 20*b* can be locked in one position of the plurality of positions by a spring loaded pin 22. As can be seen on attachment pivot 20*a*, the attachment pivots include a connection member 23. Leg 24 can be connected to the main body 16 by the connection member 23. Leg 24 has a telescoping section 25 to increase or decrease the length of the leg. The telescoping functions of legs 24 and 26 allow each leg to be independently adjusted to a length suitable for a user.

The clamp 12 or top body and the main body 16 may be removably connected to each other. This allows the clamp 12, main body 16, and accessories to be taken apart from each other for use or for storage.

A pivot member 28 is located between the clamp 12 and the main body 16. The pivot member 28 may be a separate component connected to the clamp 12 by any means known in the art such as a bolts, screws, glue, etc. or may be part of the clamp body 13. The pivot member 28 attaches the clamp 12 to the main body 16 by a pivot bolt 29. An axle, tapered pin, bearings, spindle or eccentric cam could be used in place of the pivot bolt. Alternatively, the pivot member 28 can be connected to the main body 16 rather than the clamp 12 and the pivot bolt 29 through the clamp body 13. The clamp 12 can be rotated or rocked from side to side about the pivot bolt 29 along a longitudinal axis. The clamp could rotate from 0 degrees to about 90 degrees from the horizontal axis depending on the shape of the main body 16. As shown in FIG. 1, the clamp 12 can be rotated from a horizontal position (0 degrees) to about 20 degrees downward to the left or the right of the pivot bolt 29, as the upper wall of the main body 16 prevents the clamp 12 from rotating past this point. The rotating capability allows a firearm user to pivot the firearm for aiming without the need to adjust the legs. For example, by pivoting the clamp 12 with a rifle attached a user could adjust where the rifle will be aimed along a longitudinal axis without having to move the bipod legs. The clamp 12 can be rotated by a user moving the clamp 12 itself or by adjusting a lever 32 attached to the pivot bolt 29. The lever 32 can also be used to tighten the pivot bolt 29 and lock the pivot member 28 in place so the clamp 12 cannot rotate.

The back view of the bipod is shown in FIG. 2. The bipod 10 includes a clamp section 12, a main body 16 with attachment pivots 20*a* and 20*b*, and two legs 24, 26. The lever 32 is used to rotate the clamp 12 and also to tighten the clamp 12 in place. The lever 32 is mounted to a stud that is threaded into the main body 16. There is a shaped pivot recess in the main body that the stud protrudes through and a washer between the lever 32 and the pivot recess. The lever 32 threads onto the stud clockwise and tightens against the washer. To release tension and allow the pivot to rotate around the pivot bolt 29 the lever 32 can be turned counter clockwise. This will allow the clamp 12 to pivot around the pivot bolt. To lock the clamp 12 in a desired position the lever 32 can be rotated clockwise until it tightens against the pivot.

Figure 3:
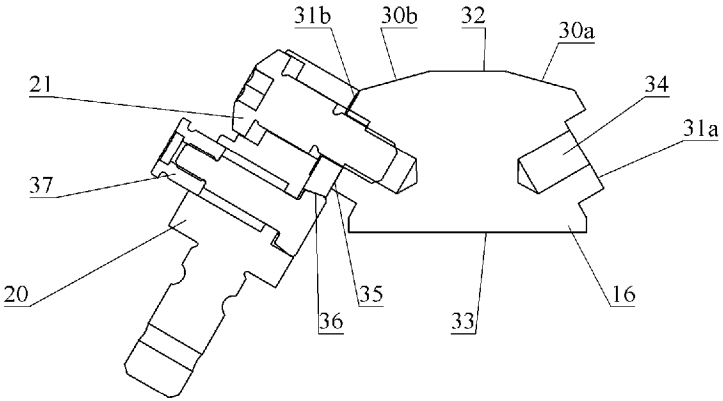
FIG. 3 is a front view of a main body and a clamp of the modular device support system and an exploded view of an attachment pivot on the main body, according to one embodiment.

FIG. 3 shows a section view of the main body 16 shown in FIG. 1. The main body 16 has upper walls 30*a*, 30*b*, side walls 31*a*, 31*b*, a top wall 32 and a bottom wall 33. The upper walls 30*a*, 30*b* slope downwardly from the top wall 32 and prevent a clamp from rotating past the upper walls 30*a*, 30*b*. The upper walls 30*a*, 30*b* are shown at about a 20 degree angle downwardly from the top wall 32 but the upper walls 30*a*, 30*b* could be sloped anywhere from 0 degrees to 90 degrees. Side walls 31*a*, 31*b* have an aperture 34 for attaching an attachment pivot to the main body 16 by securing a bolt on the attachment pivot within the aperture 34. The bolt could be replaced with anything that allows the attachment pivot to rotate including but not limited to an axle, splined pin, spindle, etc. An attachment pivot 20 is attached to the main body 16 along the side wall 31*b* by a bolt 21. The side walls 31*a*, 31*b* are symmetrical and are angled outwardly from the upper walls 30*a*, 30*b* to the bottom wall 33 and therefore the attached attachment pivot 20 also angles outwardly as shown in FIG. 3. Although only one attachment pivot 20 is shown, it should be understood that symmetrical and opposite structures are present when an attachment pivot in attached to side wall 31*a*.

Figure 4:
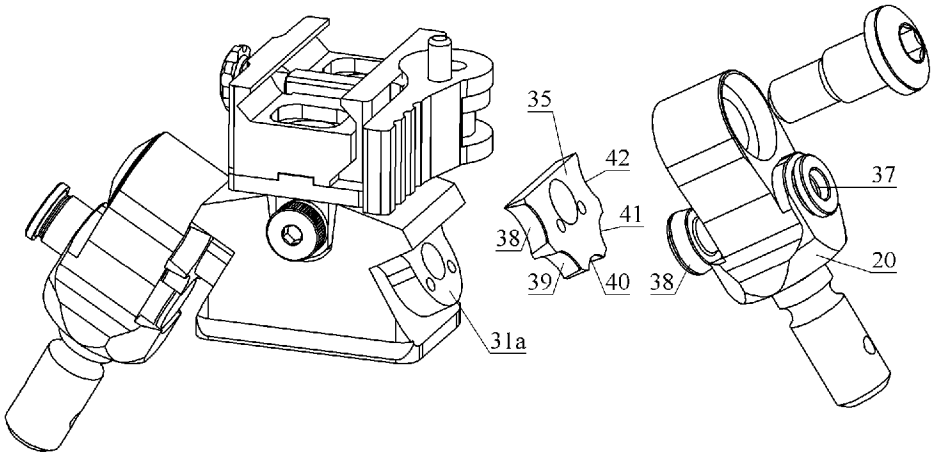
FIG. 4 is a section view of a main body of a modular device support system, according to one embodiment.
Figure 5:
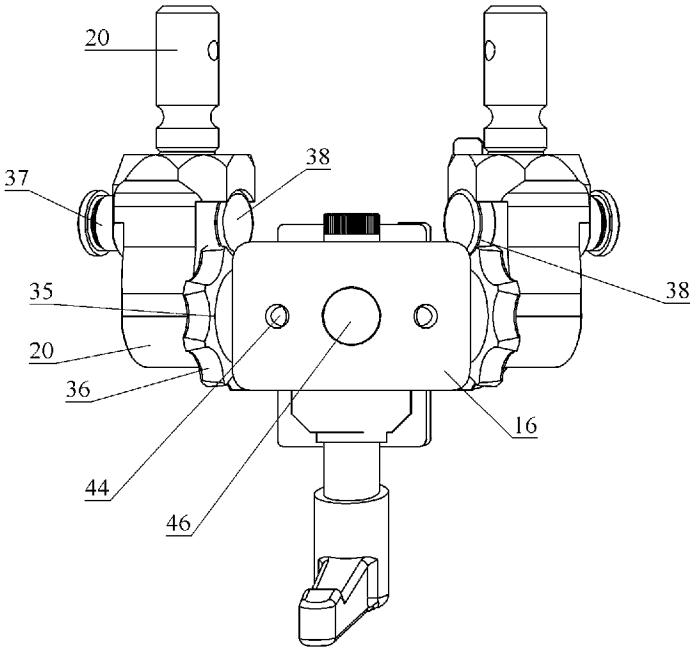
FIG. 5 is a bottom view of a main body of the modular device support system, according to one embodiment.

The main body 16 includes a fixed gear 35 on the side wall 31*a*, as is shown in FIG. 4. The fixed gear 35 has a plurality of tapered cogs 36 in which a pin 37 on the attachment pivot 20 can fit within. Alternatively, the fixed gear 35 could have non-tapered cogs. The attachment pivot 20 may be rotated about the main body 16 by positioning the head 38 of the pin 37 within one of the plurality of tapered cogs 36. A pin is used here to describe any device capable of holding the attachment pivot 20 in a locked position including but not limited to a bolt or screw. This allows the modular device support system the capability of adjusting the location of the attachment pivot 20 in relation to the main body 16. The fixed gear 35 may have a multitude of tapered cogs 36 or may have a small number of tapered cogs. In some cases having a small number of tapered cogs may help a user to position the attachment pivots 20 in a symmetrical fashion. The fixed gear 35 may be used to adjust the attachment pivot 20 to various positions relative to the main body 16. For example, the attachment pivot 20 could be placed in a generally downward position 40 as shown in FIG. 1, an angled forward position 39, an angled back position 41, a folded forward position 38 as shown in FIG. 5, or a folded back position 42. The folded forward position 38 or folded back position 42 allows the bipod to be very compact, whether mounted to a firearm or removed from a firearm for storage. The folded forward position may also be used when adapters for other accessories are added to the bipod as shown in FIG. 8*b*. The angled forward position 39, angled back position 41 and downward position 40 may be utilized to support a firearm during use. Furthermore, the pins 37 of the attachment pivots 20*a*, 20*b* could be placed in non-corresponding cogs, such that the attachment pivots are at different angles from each other relative to the main body. For example, one attachment pivot could be in an angled forward position while the other attachment pivot was in an angled back position. The ability to adjust the attachment pivots to non-corresponding cogs may be useful for users who are on uneven or varied terrain, sloped surfaces, or using the bipod from unusual angles.

The pin 37 on the attachment pivot 20 is used for adjusting the position of the attachment pivot 20 relative to the main body 16. The pin 37 may be spring loaded allowing a user to pull or push the pin 37 out of engagement with a tapered cog, rotate the attachment pivot to a desired position, and then release the pin to cause engagement with another tapered cog and lock the attachment pivot in place. The tapered cog allows the pin to slide into a desired position regardless of whether the pin is positioned directly above the tapered cog when it is released. The pin 37 may be any shape that is capable of fitting within one of the tapered cogs. Alternatively, the pin 37 may have a corresponding taper to the tapered cog so that the pin fits tightly within the tapered cog.

The gear 35 may be made from a different material then the main body. For example, the gear could be made from a hardened stainless steel and the main body out of aluminum. This may be advantageous since the gear must withstand more use and contact than the main body. The gear 35 can also be replaced or serviced without replaced the whole main body. Alternatively, apertures may be within the main body 16 itself rather than having a fixed gear attached to the main body. The apertures could be any shape that would allow the head of a pin to fit within and hold the attachment pivots in place, the apertures could also be tapered so the pin does not have to line up directly with the aperture to be engaged within. The main body 16 could have a plurality of apertures in which the head of a pin on an attachment pivot could fit within, which may include a multiple of apertures or a limited number of apertures. The apertures would be used to adjust the attachment pivot to various positions relative to the main body 16.

FIG. 5 shows a bottom view of the main body. The fixed gear 35 has a plurality of cogs 36. The head 38 of the pin 37 is fitted within a cog in the folded forward position 38. This allows the bipod to be compact, whether mounted to a firearm or removed from a firearm for storage. The bottom of the main body 16 may also have holes for mounting additional accessories. A hole 44 may be used for adding additional accessories such as a mounting rail for attaching lights, lasers, etc. An attachment could also be added that would be able to accept a third leg enabling the bipod to be changed into a tripod for extra functionality and stability. A hole 46 could be used to accept a sling quick detach hardware or flush cup sling attachment hardware. The hole 46 could have an anti-rotational slot to prevent twisting of the sling attachment hardware.

Figure 6:
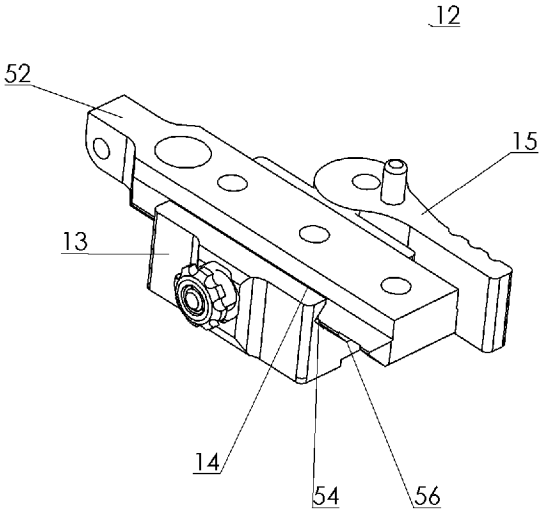
FIG. 6 is a side view of a clamp of the modular device support system, according to another embodiment.

The side view of a clamp is shown in FIG. 6. The clamp 12 includes a clamp body 13, a pair of clamp claws 14, and a tightening lever 15. An accessory rail 52 is shown as being held between the clamp claws 14. It should be understood that a firearm would be attached to the accessory rail 52, however it has been left out to better view the other components. Furthermore, a skilled reader should note that the mounting mechanism shown and described here is only one example of several known in the art.

The accessory rail 52 fits securely between the tapered walls 54 of the opposing clamp claws 14 and the upper wall 56 of the clamp 12. The tightening lever 15 is used to release the clamp claws 14 from a locked position by the use of a lock button and then can be rotated to move the clamp claws 14 to an open position. A pair of springs could be utilized to push the clamp claws 14 outwardly. Once the clamp claws 14 are in an open position the accessory rail 52 can be accepted into the recess provided by the tapered walls 54 of the clamp claws 14 and the upper wall 56 of the clamp 12. The tightening lever 15 can be rotated to close the clamp claws 14 around the accessory rail 52 and a lock on the tightening lever 15 can be engaged to prevent the clamp claws 14 from releasing the accessory rail 52. The tapered walls 54 and the upper wall 56 created a dovetail recess for engaging the dovetail shaped accessory rail 52.

Figure 7:
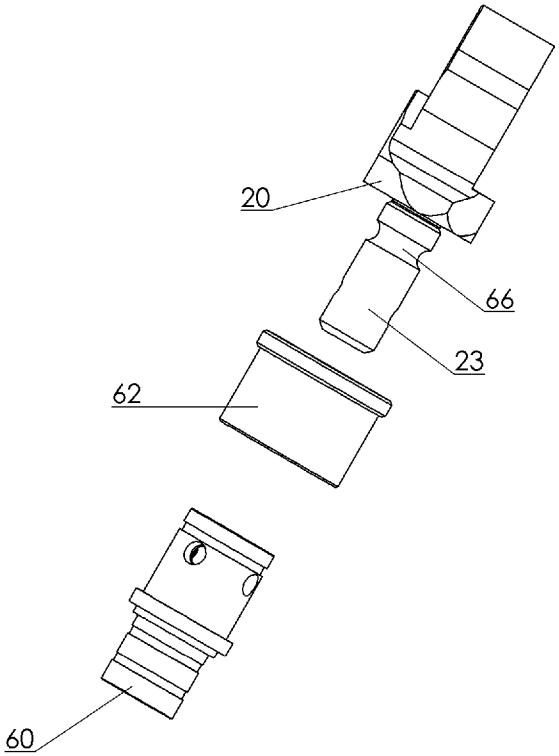
FIG. 7 is an exploded view of an accessory connecting to an attachment pivot of the modular device support system, according to yet another embodiment.

As shown in FIG. 7, the attachment pivot 20 includes a connection member 23. Different accessories, legs, or adaptors (collectively referred to as accessories) can be attached to the main body 16 by the connection members. The accessories can be connected to a connection member 23 by any mechanism known in the art including but not limited to a spring loaded collar, bolts, or screwing the pieces together. The spring loaded collar connection mechanism is shown in FIG. 7. An accessory 60 slides on to the connection member 23 of the attachment pivot 20. The accessory 60 has a ball bearing collar 62 that is spring loaded. When the collar 62 is in an extended position it urges a series of balls bearings towards the connection member 23. The balls bearings are accepted by a groove 66 on the connection member 23 and the accessory 60 is locked on to the connection member. When collar 62 is retracted, it no longer urges ball bearings into the groove 66 which allows the ball bearings to disengage the groove 66 and the accessory 60 to be quickly removed from the connection member 23.

The accessory can also be connected to a connection member by screwing the pieces together. The connection member may have screw threads and are sized to mate with a complementary internal thread formed into the inside of the collar of the accessory. The attachment can quickly be twisted on the connection member to lock the accessory in place, and similarly can be twisted off the connection member for quick removal of the accessory. The accessory could also be connected to a connection member by a bolt or pin. In this case, the accessory would slide onto the connection member, lining up small holes in which a pin could be inserted through the holes to hold the accessory in place. The pin would be released for quick removal of the accessory. A threaded bolt or other fastener could also be used in place of the pin.

Accessories may have a telescoping function that allows the accessory length to be increased or decreased. The telescoping function also allows the accessories to be adjusted independently of each other to a suitable length for the terrain and user. The accessories can telescope by any mechanism known in the art including the mechanism described above in reference to the connection of attachments to a connection member.

One of the accessories that can be attached to a connection member are legs, such as legs 24 and 26 shown in FIGS. 1 and 2. Legs may be any length including a short, medium, or long length, and could include a telescoping function. A user may choose a short length leg for instances where the user is laying prone. A user may choose a medium length leg for instances where the user is sitting or kneeling. Or a user may choose a long length leg for instances where the user is standing. The legs can be removed from the connection member of the attachment pivot and replaced with another leg or accessory quickly and with minimal effort. Furthermore, the legs could be removed from the connection member and stored while only the main body and clamp remain attached to the firearm. Legs could be constructed from any material including but not limited to carbon fiber, aluminum, plastic, etc.

Accessories could also include spiked feet, trekking poles, sand bags, barricade stops, or an adapter.

Figure 8A:
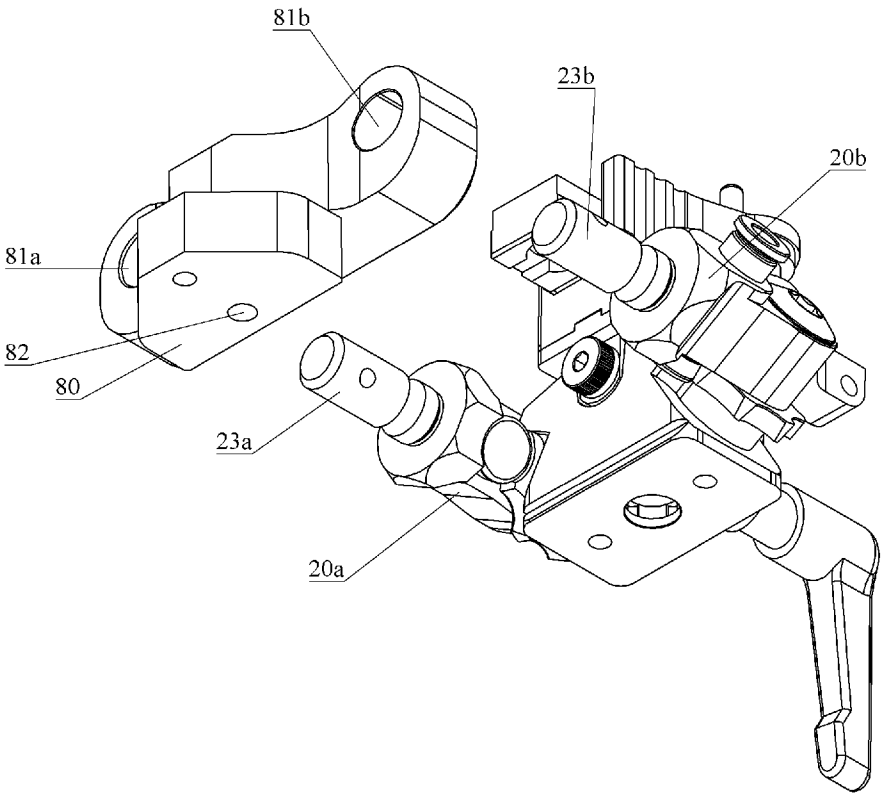
FIG. 8*a* is a bottom view of an adapter and a main body of the modular device support system, according to another embodiment.
Figure 8B:
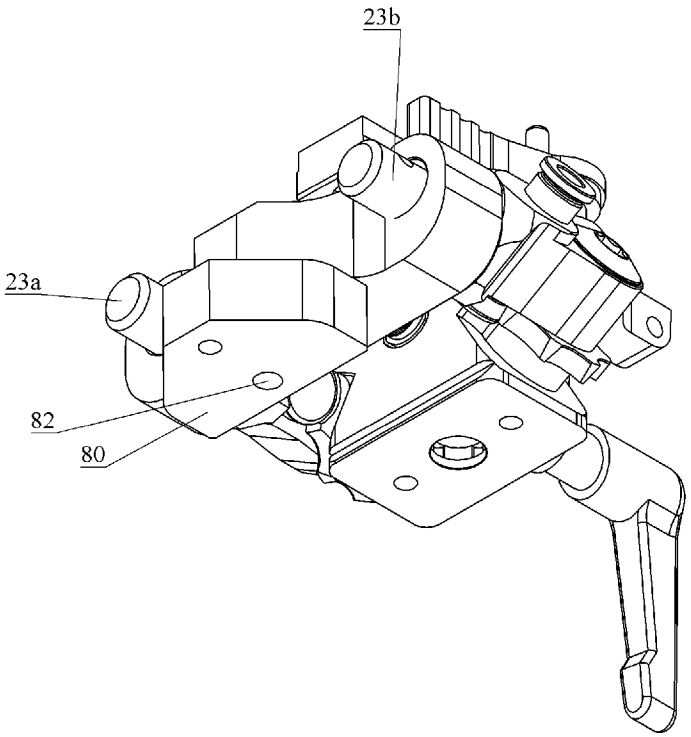
FIG. 8*b* is a bottom view of an adapter connected to a main body of the modular device support system, according to one embodiment.

As seen in FIG. 8*a*-8*b*, an adaptor 80 can be added to the connection member 23*a*, 23*b* of the attachment pivots 20*a*, 20*b*. An adaptor can be added to the connection members when the attachment pivots are in a folded forward position or folded back position. The adaptor 80 has two holes 81*a*, 81*b*, with hole 81*a* being sized to slide onto connection member 23*a* and hole 81*b* being sized to slide onto connection member 23*b*. Although the holes and the connection member are shown as being cylinder shaped, it should be understand that any corresponding shapes or sizes could be used. The adaptor 80 has at least one mounting hole 82. The mounting hole 82 could be sized to accept a specialized tripod, a universal camera tripod, or other universal camera attachment. One adapter could have many mounting holes 82 capable of accepting different attachments. Alternatively, an adapter could have one mounting hole 82. In FIG. 8*b* the adapter 80 is locked onto the attachment pivots 23*a*, 23*b*. The adapter can be locked using any attachment mechanism including but not limited to ball bearings, bolt, screw, etc.

The ability to change the modular device support system into a tripod may be useful when using the support system for photography or other nature watching purposes. It can also be used to support a firearm.

Although the present embodiments have been described with reference to specific example embodiments, it will be evident that various modifications and changes may be made to these embodiments without departing from the broader spirit and scope of the various embodiments.

Accordingly, the specification and drawings are to be regarded in an illustrative rather than a restrictive sense.

What is claimed is:

1. A modular device support system, comprising:

a top body for attaching to a device needing support;

a main body having a side wall and an opposing side wall, the side wall and the opposing side wall each having a plurality of recesses, the top body and the main body capable of connecting to each other;

a first attachment pivot mounted on the side wall of the main body that can rotate independently to any recess of the plurality of recesses and be adjustably fixed in one position of a plurality of positions by a pin on the first attachment pivot mating with one of the recesses of the plurality of recesses;

a second attachment pivot mounted on the opposing side wall of the main body that can rotate independently to any recess of the plurality of recesses and be adjustably fixed in one position of a plurality of positions by a pin on the second attachment pivot mating with one of the recesses of the plurality of recesses; and a first leg having at least one groove that can fit ball bearings from a ball bearing collar on the first attachment pivot and a second leg having at least one groove that can fit ball bearings from a ball bearing collar on the second attachment pivot, the first leg connecting to the first attachment pivot when ball bearing are urged from the ball bearing collar into the at least one groove and the second leg connecting to the second attachment pivot when ball bearings are urged from the ball bearing collar into the at least one groove, both the first leg and the second leg being adjustable in length.

2. A modular device support system, comprising:

a clamp for removably attaching to a device needing support;

a main body having a side wall and an opposing side wall, the side wall and the opposing side wall each having a plurality of recesses;

a first attachment pivot mounted on the side wall of the main body that can rotate independently to any recess of the plurality of recesses and be adjustably fixed in one position of a plurality of positions by a pin on the first attachment pivot mating with one of the recesses of the plurality of recesses;

a second attachment pivot mounted on the opposing side wall of the main body that can rotate independently to any recess of the plurality of recesses and be adjustably fixed in one position of a plurality of positions by a pin on the second attachment pivot mating with one of the recesses of the plurality of recesses;

a pivot system connecting the clamp and the main body and allowing the clamp to rotate about a pivot axis;

a first leg that is adjustable in length having at least one groove that can fit ball bearings from a ball bearing collar on the first attachment pivot that can removably connect to the first attachment pivot when ball bearing are urged from the ball bearing collar into the at least one groove; and a second leg that is adjustable in length having at least one groove that can fit ball bearings from a ball bearing collar on the second attachment pivot that can removably connect to the second attachment pivot when ball bearings are urged from the ball bearing collar into the at least one groove.

3. The modular device support system of claim 2, wherein the device needing support is a firearm.

4. A modular device support system, comprising:

a clamp for removably attaching to a device needing support;

a main body having a side wall and an opposing side wall, the side wall and the opposing side wall each having a plurality of recesses;

a first attachment pivot mounted on the side wall of the main body that can rotate independently to any recess of the plurality of recesses and be adjustably fixed in one position of a plurality of positions by a pin on the first attachment pivot mating with one of the recesses of the plurality of recesses;

a second attachment pivot mounted on the opposing side wall of the main body that can rotate independently to any recess of the plurality of recesses and be adjustably fixed in one position of a plurality of positions by a pin on the second attachment pivot mating with one of the recesses of the plurality of recesses;

a pivot system connecting the clamp and the main body and allowing the clamp to rotate about a pivot axis;

a first leg having internal threads that can mate with external threads on the first attachment pivot allowing the first leg to be screwed onto and off of the first attachment pivot; and a second leg having internal threads that can mate with external threads on the second attachment pivot allowing the second leg to be screwed onto and off of the second attachment pivot.

5. The modular device support system of claim 4, wherein the first leg and the second leg are adjustable in length.

6. The modular device support system of claim 4, wherein the device needing support is a firearm.

7. A modular device support system, comprising:

a top body for attaching to a device needing support;

a main body having a side wall and an opposing side wall, the side wall and the opposing side wall each having a plurality of recesses, the top body and the main body capable of connecting to and detaching from each other;

a first attachment pivot mounted on the side wall of the main body that can rotate independently to any recess of the plurality of recesses and be adjustably fixed in one position of a plurality of positions by a pin on the first attachment pivot mating with one of the recesses of the plurality of recesses;

a second attachment pivot mounted on the opposing side wall of the main body that can rotate independently to any recess of the plurality of recesses and be adjustably fixed in one position of a plurality of positions by a pin on the second attachment pivot mating with one of the recesses of the plurality of recesses;

a first leg having internal threads that can mate with external threads on the first attachment pivot allowing the first leg to be screwed onto and off of the first attachment pivot; and a second leg having internal threads that can mate with external threads on the second attachment pivot allowing the second leg to be screwed onto and off of the second attachment pivot.

8. The modular device support system of claim 7, wherein the first leg and the second leg are adjustable in length.

9. The modular device support system of claim 7, wherein the device needing support is a firearm.

* * * * *